US006336421B1

(12) United States Patent
Fitzgerald et al.

(10) Patent No.: US 6,336,421 B1
(45) Date of Patent: Jan. 8, 2002

(54) FLOATING SPAR FOR SUPPORTING PRODUCTION RISERS

(75) Inventors: John A. Fitzgerald, New Orleans, LA (US); Harold B. Skeels, Kingwood, TX (US)

(73) Assignee: FMC Corporation, Houston, TX (US)

( * ) Notice: Subject to any disclaimer, the term of this patent is extended or adjusted under 35 U.S.C. 154(b) by 0 days.

(21) Appl. No.: 09/350,332

(22) Filed: Jul. 9, 1999

Related U.S. Application Data

(60) Provisional application No. 60/092,354, filed on Jul. 10, 1998.

(51) Int. Cl.[7] ..... B63B 35/44; E21B 7/128

(52) U.S. Cl. ..... 114/264; 166/353

(58) Field of Search ..... 114/264, 266; 166/345, 350, 351, 353, 354, 366, 367, 368

(56) References Cited

U.S. PATENT DOCUMENTS

| | | | | |
|---|---|---|---|---|
| 3,265,130 A | | 8/1966 | Watkins | |
| 3,602,302 A | * | 8/1971 | Kluth | 166/336 |
| 3,638,722 A | * | 2/1972 | Talley, Jr. | 166/338 |
| 3,744,561 A | | 7/1973 | Shatto et al. | |
| 4,194,568 A | | 3/1980 | Buresi et al. | |
| 4,211,281 A | * | 7/1980 | Lawson | 166/345 |
| 4,234,047 A | | 11/1980 | Mott | |
| 4,281,716 A | * | 8/1981 | Hall | 166/339 |
| 4,378,848 A | * | 4/1983 | Millberger | 166/351 |
| 4,398,846 A | * | 8/1983 | Agdern | 405/185 |
| 4,624,318 A | | 11/1986 | Aagaard | |
| 4,702,321 A | * | 10/1987 | Horton | 166/350 |
| 4,704,050 A | * | 11/1987 | Wallace | 405/224.2 |
| 4,730,677 A | * | 3/1988 | Pearce et al. | 166/345 |
| 4,906,139 A | * | 3/1990 | Chiu et al. | 405/223.1 |
| 5,706,897 A | | 1/1998 | Horton | |
| 5,722,797 A | * | 3/1998 | Horton, III | 405/224 |
| 5,875,848 A | | 3/1999 | Wolff et al. | |
| 5,887,659 A | | 3/1999 | Watkins | |
| 5,971,077 A | * | 10/1999 | Lilley | 166/368 |

FOREIGN PATENT DOCUMENTS

WO 84/01554 * 4/1984

OTHER PUBLICATIONS

"FMC Provides Surface and Subsea Systems for World's First Production Spar," Advances, Spring 1997, pp. 6–7.
"Horizontal Subsea Completion Systems," Advances, Spring 1997, pp. 8–9.
Oryx Energy Neptune CNG Brochure, "Pushing the Potential", Apr. 1996.

* cited by examiner

*Primary Examiner*—S. Joseph Morano
*Assistant Examiner*—Andrew Wright
(74) *Attorney, Agent, or Firm*—Gary L. Bush; James L. Jackson; Andrews, Kurth, Mayor, Day, Caldwell & Keeton, LLP

(57) ABSTRACT

A subsea system is provided for producing a number of subsea wells which may be arranged in groups. Each of the groups of subsea wellheads is connected to deliver production flow to a subsea manifold and each subsea manifold is connected to deliver production flow to a production riser. A plurality of production risers each being connected to receive production flow from one of said subsea manifolds extend from the subsea manifolds for groups of wells. A deep draft floating spar is located generally above the subsea wellheads with mooring lines and has a production platform located above the sea surface and has buoyancy and ballast chambers to control floatation. The spar structure defines a riser bore receiving the production risers extending from the subsea wellheads to the production platform. The spar is also capable of being shifted laterally by its mooring lines for positioning above a selected well to thus permit well intervention activities as needed. The subsea wells are each provided with wellheads having a removable cap to permit ROV actuated cap removal and replacement as needed to permit well intervention.

6 Claims, 2 Drawing Sheets

FLOATING SPAR FOR SUPPORTING PRODUCTION RISERS

Applicants hereby claim the benefit of United States Provisional Application Serial No. 60/092,354 which was filed on Jul. 10, 1998 by John A. Fitzgerald and Harold B. Skeels and entitled Floating Spar For Supporting Production Risers, which Provisional Application is incorporated herein by reference for all purposes.

BACKGROUND OF THE INVENTION

1. Field of the Invention

This invention relates to a floating spar for supporting a production platform, and more particularly to such a floating spar for supporting production risers extending from subsea manifolds to the production platform in deep water offshore wells.

2. Description of the Prior Art

Oil and gas production spars currently utilize a number of subsea wells placed a given lateral distance on the sea floor and connected to surface facilities via individual risers where a Christmas tree is attached for well control. Wells for deepwater typically are very heavy given their extended length and in some cases multiple barriers where multiple concentric casing riser joints exist. Since a production spar is a floating vessel, each riser must be vertically tensioned to maintain its structural integrity. Hydraulic piston assemblies, electro-mechanical devices, and dashpots are some of the mechanisms used to maintain a constant tension while the spar is heaving or moving laterally (due to the ocean environmental forces). Buoyancy devices attached to riser strings have also been used to allow the risers to free stand independently of the spar's hull. This method is the most advantageous with respect to the spar since the tension created by the buoyancy devices are not transferred to the spar hull, thereby freeing up the displacement of the spar's hull to support the weight of the spar and the facilities placed on top.

The drawback to this method is size. To make an offshore production spar economically viable, several wells must be tied back to the surface facility, each requiring a certain amount of space in the center of the spar for the riser and its buoyancy devices. As water depth increases, riser weight increases. As riser weight increases, space for buoyancy to hold up the riser increases. As the space increases, so does the spar's hull diameter to accommodate the need for added space. If the spar's hull is larger, it is more costly to build and install, requiring more wells. Therefore a spar may reach an economic limit, simply because the water depth and number of wells create a spar hull so large as to make it uneconomical. Another aspect that may increase riser weight or size is the concept of "barriers". If a well's fluid control devices (tree and manifolds) are at the surface, there may be a requirement for extra conduits in the riser design for both structural protection and pressure containment. Added conduits will increase both size and weight to the riser.

U.S. Pat. No. 5,706,897 dated Jan. 13, 1998 is directed to a floating spar which is a deep-draft floating caisson of a hollow cylindrical construction and utilized primarily for deep water offshore well operations at depths of 2,000 feet or more. The floating spar is anchored by mooring lines to the sea floor and may extend seven hundred feet, for example, below the surface of the water. The spar or caisson shown in the '897 patent is directed primarily to a caisson for drilling risers for supporting a high pressure drilling riser and a low pressure drilling riser extending from a subsea wellhead. FIGS. 9 and 10, however, are directed to production risers in which a subsea tree is added to provide a mechanical safety barrier at the sea floor. Above the subsea tree is the vertical riser extending to a production manifold at the surface. An additional surface tree is provided for fluid control purposes. Thus, a production riser extends from each subsea wellhead to the surface location via a subsea tree, riser conduit, surface tree, and surface manifold.

The utilization of individual production risers extending from each subsea wellhead through the spar to a surface manifold and surface tree results in a substantial weight exerted on the spar particularly when multiple subsea wellheads, such as ten or more, are being utilized for product supply. Also, a substantial space within the spar or caisson is required for the multiple lines extending through the space to the surface platform or deck. Floatation tanks within the spar are utilized for tensioning the risers. In some instances, the risers and wellhead connector are deployed and recovered through the internal diameter of the buoys. The buoys must therefore be sized to permit the passage of the large diameter wellhead connector which normally controls the internal diameter of the spar and contributes to the overall size of the spar.

It is desired that a spar be of a minimal size and weight for minimizing costs and simplifying construction, installation and operation.

SUMMARY OF THE INVENTION

The present invention is directed to an offshore production system utilizing a spar or caisson anchored to the sea floor by mooring lines and supporting a production platform above the sea level. A plurality of subsea wellheads each has a subsea tree mounted thereon with a removable tree cap to permit access to the subsea tree and subsea wellhead. Production conduits from the annulus and production bores of each subsea tree extend to either: a production riser to the spar or a subsea manifold which receives conduits from multiple subsea trees, such as five or ten subsea trees, for example. Subsea manifolds are normally provided, particularly when a plurality of the subsea wells are located nearby each other to reduce the number of conduits extending to a surface location. Production risers from subsea trees and/or manifolds extend from the sea floor through the spar to the production platform on top of the spar. Also, test lines and umbilical lines may extend from the subsea trees and manifolds through the spar to the production platform for flow control, test or maintenance work. The production risers from the subsea tree and manifolds may be flexible cables or vertical centenary risers and formed of various materials.

To intervene or provide access to the subsea tree, such as the tubing string, the spar may be positioned over the designated well with the intervention riser system over the tree. The tree cap is then removed and the intervention system is then landed and locked onto the top of the tree thereby permitting intervention in the well. To minimize intervention hardware weight and the number of trips that equipment has to travel between the surface and the sea floor, the subsea trees may utilize a light weight tree cap which may be deployed and recovered by a remotely operated vehicle (ROV).

Utilizing subsea technology, the costs of deepwater spars are reduced by reducing the number of risers between the sea floor and the spar. Instead of individual risers for each well, the wells are completed in a standard subsea configuration which are subsequently sent to the surface individually via a light weight minimal barrier riser, or co-mingled together via manifolding on the sea floor and sent to the surface by a single larger bore riser to the spar facility. The production riser(s) may be vertically supported in the same manner as individual well risers. The production riser itself may be larger in diameter than the individual well riser, requiring bigger buoyancy to support its weight. Other risers for pipeline pigging, well testing, and control (electrical/hydraulic line) cables to operate the subsea wells may also be needed, but the overall number of suspended conduits from the spar is drastically reduced for the same number of wells. The fewer number of conduits required results in a smaller space and spar hull size requirement; leading to lower spar hull fabrication costs. Subsea multi-well technology also does not limit the number of wells needed, nor the structural and geometric problems of a riser associated with the lateral reach out to outlying wells. In addition, single subsea wells with a subsea tree leading to a production pipeline/riser conduit act as both the safety barrier and flow control are a simpler design and a more cost effective approach to the subsea safety tree and surface tree on either end of the spar riser configuration.

The reduced area for risers also lets the spar better utilize its deck space and displacement capacity for drilling and workover derricks, subsea risers and subsea blowout preventers. With fewer risers, the spar may move about on its anchor mooring spread to position itself over any well for subsea drilling completion or workover operations permitting tubing intervention into individual subsea wells.

It is an object of this invention to provide a deep-draft floating spar of minimum size and weight for supporting production risers extending from subsea manifolds to a production platform on the spar.

A further object of this invention is to provide such a subsea production system utilizing subsea trees which have a removable tree cap for intervention and access to the subsea well without necessarily going through the production riser. Small intervention well control hardware can be run and suspended from the spar for periodic maintenance and workovers.

Another object of the invention is the provision of such a spar subsea production system in which subsea trees have production pipelines extending to subsea manifolds which, in turn, have production risers extending from the manifolds through the spar to the production platform thereby eliminating surface trees and minimizing any surface manifolds for the production platform.

Other objects, features, and advantages of the invention will be more apparent from the following specification and drawings.

DESCRIPTION OF THE INVENTION

Figure 1:
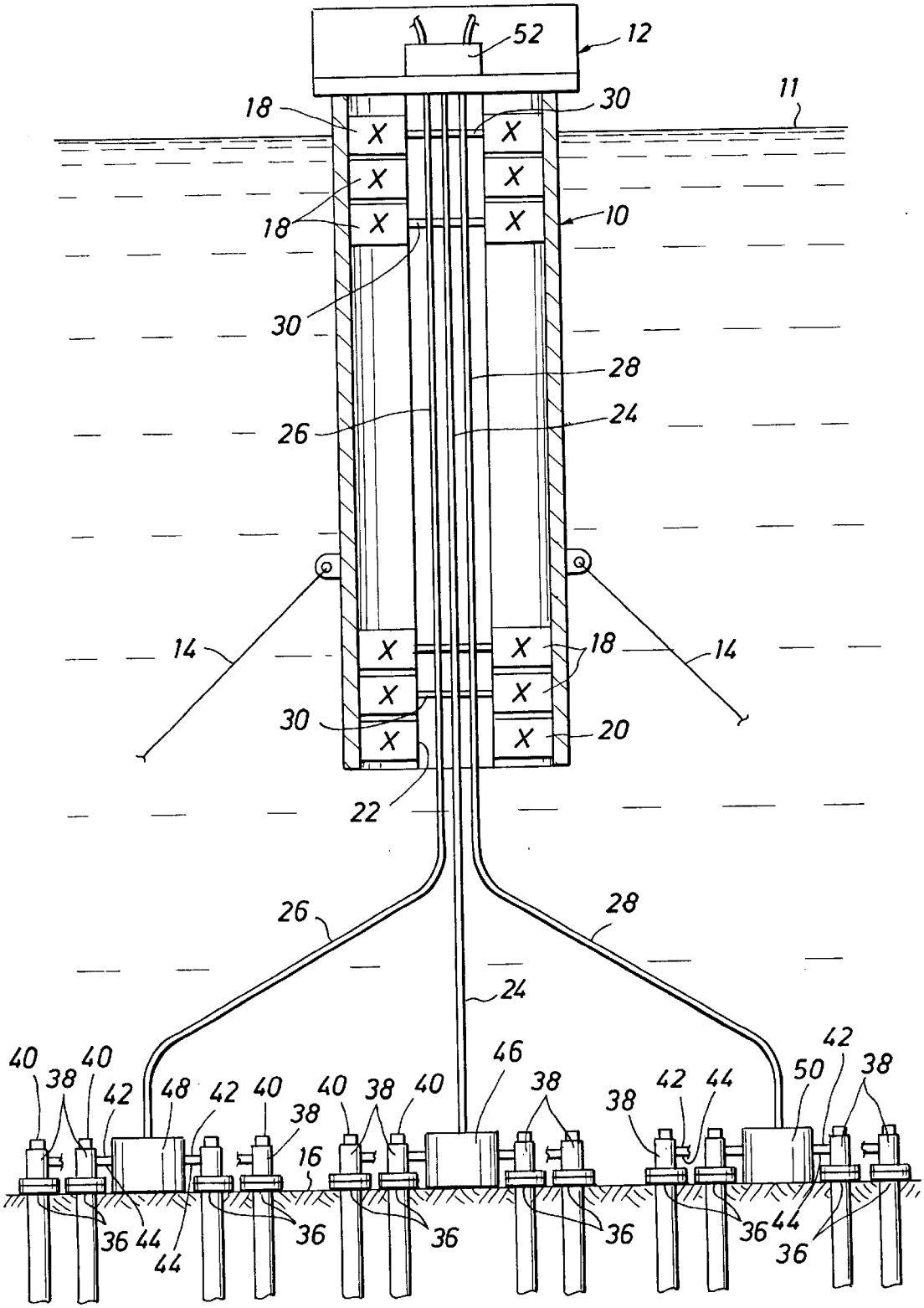
FIG. 1 is a schematic view of a floating spar production system including a production platform supported on a buoyant spar with product risers extending from subsea manifolds (or subsea trees) through a deep-draft caisson spar to the production platform.

Referring to the drawings a floating spar or caisson is generally indicated at 10 having a production platform 12 with a plurality of decks mounted thereon above the sea level 11. Spar 10, for example, may be about 700 feet in length and about 75 feet in diameter, with the water depth over about 2000 feet. Mooring lines 14 are secured to anchor piles (not shown) on sea floor 16 for anchoring of spar 10. Six (6) or eight (8) mooring lines 14 are preferably utilized for mooring of spar 10. Buoys which comprise buoyancy tanks or chambers 18 are mounted within spar 10 along with ballast chambers 20. An axial bore or slot 22 is provided in spar 10 through buoyancy tanks 18 and ballast chambers 20 to receive a plurality of production risers 24, 26, 28. Test and umbilical lines may also be provided within spar 10. Suitable support members 30 on spar 10 within riser bore 22 support production risers 24, 26 and 28.

Mounted on sea floor 16 are a plurality of subsea wellheads 36. Each subsea wellhead 36 has a subsea tree 38 connected thereto with a suitable connector and an upper removable tree cap 40 is provided on each subsea tree 38. A horizontal subsea tree having a removable tree cap which is satisfactory may be purchased from the FMC Corporation, Petroleum Equipment and Systems Division, of Houston, Tex. Subsea tree 38 is preferable of a dual bore type. Production and annulus conduits 42, 44 extend from each subsea tree 38 to an associated dual bore subsea manifold 46, 48 or 50 on sea floor 16. Riser 42 extends from the tubing string of the well while riser 44 extends from the annulus of the well. Production risers 24, 26 and 28 from respective subsea manifolds 46, 48 and 50 extend upwardly through riser slot 22 in spar 10 to a surface manifold 52 on production platform 12. Suitable riser supports 30 in slot 22 support production risers 24, 26 and 28. Suitable test lines and electrical/hydraulic umbilicial lines (not shown) may extend to the subsea manifolds and subsea trees for testing and control as needed.

Spar 10 may be moved as much as about 250 feet in any direction without disconnecting mooring lines 14 from spar 10. Each subsea wellhead 36 and subsea tree 38 having a removable tree cap 40 thereon is arranged so that full vertical access and workovers may be obtained by removal of the tree cap 40 without removing the subsea tree. It is necessary for various reasons to intervene into the tubing string of a subsea well from time to time, such as might be required for shifting sleeves, wax cutting, bottom hole pressure surveys, and bailing sand, for example. Wire line or coiled tubing may be utilized in an intervention riser system for intervening into the subsea well. The particular type of intervention riser system depends on various factors, such as water depth, well pressure, currents, spar length, and may be constructed of a composite material or coiled tubing.

Figure 2:
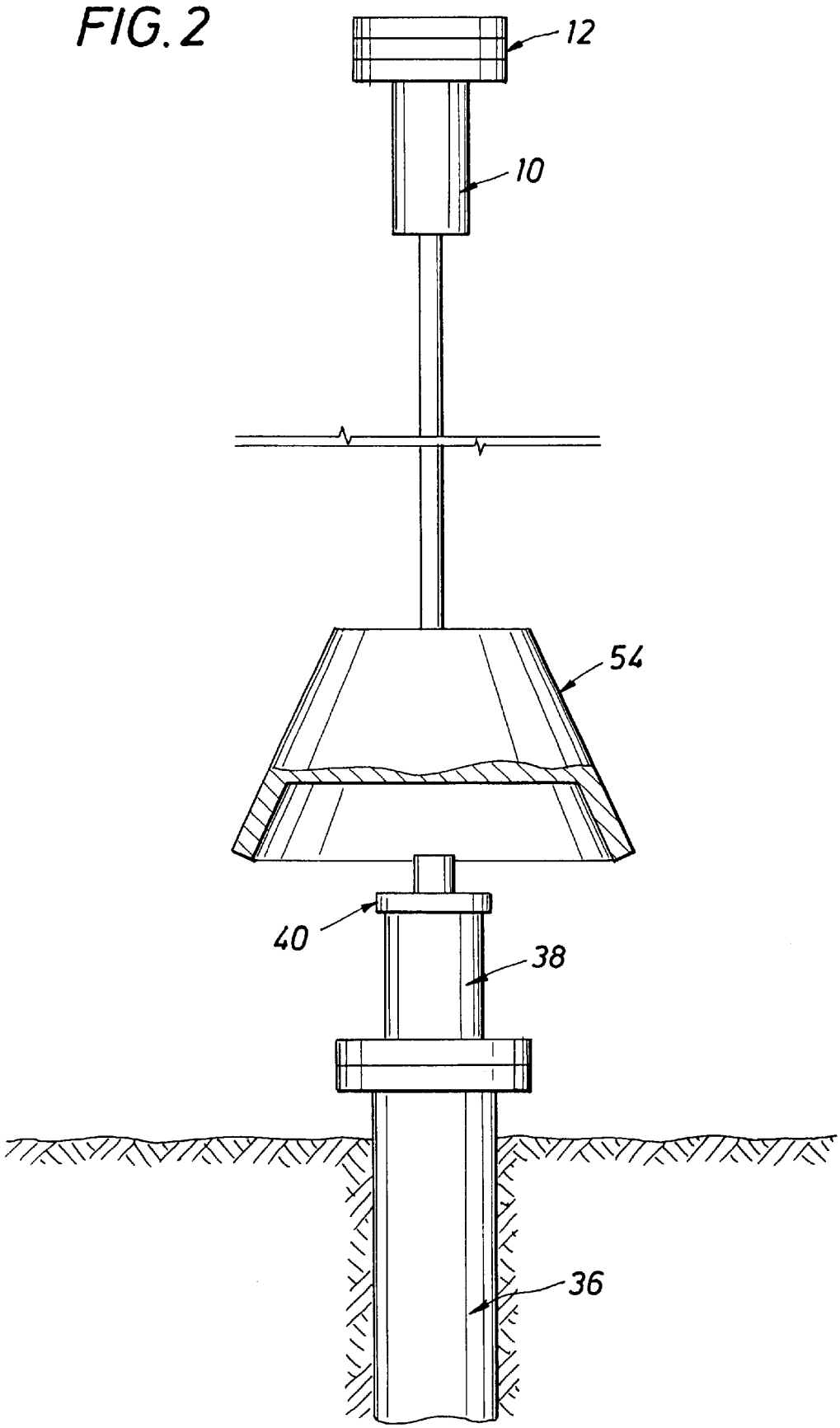
FIG. 2 is a schematic view of a subsea tree connected to a subsea wellhead and having a removable tree cap for removal by a remotely operated vehicle (ROV) to permit access to the subsea tree and subsea wellhead such as may be required for workover operations or the like using lightweight intervention techniques.

The spar 10 is first positioned vertically over the subsea tree 38 as shown in FIG. 2. A remotely operated vehicle (ROV) illustrated generally at 54 is normally utilized with the intervention riser system. Subsea tree cap 40 is first removed utilizing the ROV. An intervention system (not shown) is landed and locked onto the top of tree 38. The tree cap 40 is normally provided with a space for positioning of ROV 54 over cap 40 in an aligned position for removal of cap 40 and landing and locking of the intervention system onto tree 38. After the completion of the workover or other operation, ROV 54 picks up and reinstalls tree cap 40 and tests the connection to insure pressure integrity.

The production risers 24, 26, 28 (FIG. 1) extending through spar 10 may be tensioned, if needed, by buoys 18 within spar 10 or by piston type tensioners as well known. For further details of spar 10, the entire disclosure of U.S. Pat. No. 5,706,897 is incorporated by reference. ROV 54 may be controlled from platform 12 or a separate dive support vessel.

While three manifolds 46, 48 and 50 are illustrated with each manifold having a separate production riser extending to platform 12, it may be desirable to have only a single manifold with a single production riser extending to surface platform 12. Also, it may be desirable to combine production risers 24, 26 and 28 into a single riser extending to surface platform 12 through spar 10 as less space in spar 10 could be utilized.

In the present invention, a floating spar production system utilizes subsea trees having ROV removable tree caps and connected by risers to subsea manifolds which, in turn, have production risers extending from the subsea manifolds through the spar to the production platform. Such a system results in a spar of minimal size and weight and each subsea tree having a removable tree cap thereon is adapted for vertical access for workover or other operations.

In view of the foregoing it is evident that the present invention is one well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

We claim:

1. A subsea production and well intervention system for deployment in deep water conditions having a depth of about 2000 feet or greater, comprising:

(a) a plurality of subsea wells each having subsea wellheads located at the sea floor and being located on a defined area of the sea floor, said defined area not substantially exceeding about 250 feet in any direction:

(b) a deep draft floating spar adapted for location generally above the subsea wellheads and having a production platform located above the sea surface, having buoyancy and ballast chambers and defining a riser bore, said deep draft floating spar having a diameter less than said defined area of the sea floor and having an intervention riser system for conducting well servicing intervention on any of said plurality of subsea wells;

(c) a plurality of mooring lines for mooring said deep draft floating spar and for controlling lateral positioning of said deep draft floating spar for stationing of said intervention riser system thereof above a selected subsea wellhead intended for well servicing intervention;

(d) a plurality of subsea production manifolds each being connected to receive production flow from a group of said plurality of said subsea wellheads; and (e) a plurality of production risers each being connected to one of said subsea production manifolds and extending upwardly through said riser bore to said production platform.

2. The subsea production and well intervention system of claim 1, comprising:

(a) said subsea wellheads being arranged in groups;

(b) said subsea production manifolds each being connected to receive production flow from the subsea wellheads of one of said groups of subsea wellheads; and (c) said plurality of production risers each being connected to receive production flow from one of said subsea production manifolds and extending from a subsea production manifold through said riser bore and to said production platform.

3. The subsea production and well intervention system of claim 1, comprising:

(a) said plurality of subsea wellheads each having a removable cap, being removable to permit well intervention activities; and (b) said removable cap being removable and replaceable by ROV controlled servicing activities.

4. The subsea production and well intervention system of claim 1, comprising:

(a) said plurality of subsea wells defining groups of subsea wells, each group of subsea wells having two or more subsea wells each having a wellhead; and (b) one of said subsea manifolds being connected in production flow receiving relation with said subsea wellheads of a group of subsea wells and having one of said production risers connected in flow receiving relation therewith.

5. The subsea production and well intervention system of claim 4, comprising:

said subsea manifolds being dual bore subsea manifolds.

6. The subsea production and well intervention system of claim 4, comprising:

(a) said subsea manifolds being dual bore subsea manifolds; and (b) said plurality of subsea wellheads having production and annulus conduits for production and being connected to respective bores of said dual bore subsea manifold for a group of subsea wells.

* * * * *